US009417597B2

(12) United States Patent
Bryl et al.

(10) Patent No.: US 9,417,597 B2
(45) Date of Patent: Aug. 16, 2016

(54) POWER ASSIST SCISSOR LIFT

(71) Applicant: XEROX CORPORATION, Norwalk, CT (US)

(72) Inventors: Derek A Bryl, Webster, NY (US); Aaron M Moore, Fairport, NY (US); Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/972,236

(22) Filed: Dec. 17, 2015

(65) Prior Publication Data

US 2016/0103415 A1 Apr. 14, 2016

Related U.S. Application Data

(62) Division of application No. 13/867,272, filed on Apr. 22, 2013, now Pat. No. 9,310,753.

(51) Int. Cl.

| | |
|---|---|
| ***B65H 31/12*** | (2006.01) |
| ***B65H 31/18*** | (2006.01) |
| ***G03G 21/16*** | (2006.01) |
| ***B66F 7/08*** | (2006.01) |
| ***G03G 15/00*** | (2006.01) |
| ***B65H 31/10*** | (2006.01) |
| ***B65H 31/14*** | (2006.01) |

(52) U.S. Cl.

CPC ..... *G03G 21/1604* (2013.01); *B65H 31/10* (2013.01); *B65H 31/14* (2013.01); *B65H 31/18* (2013.01); *B66F 7/08* (2013.01); *G03G 15/6538* (2013.01); *G03G 15/6552* (2013.01); *G03G 21/1609* (2013.01); *B65H 2402/344* (2013.01); *B65H 2405/15* (2013.01)

(58) Field of Classification Search

CPC .... B65G 1/07; B65H 31/18; B65H 2402/344; B65H 2405/15; B65H 31/14; B66F 7/08; B66F 7/065

See application file for complete search history.

(56) References Cited

U.S. PATENT DOCUMENTS

| | | | | |
|---|---|---|---|---|
| 3,246,876 | A | 4/1966 | Larson | |
| 4,549,720 | A * | 10/1985 | Bergenwall | A47B 9/16 187/269 |
| 5,722,513 | A | 3/1998 | Rowan et al. | |
| 6,679,479 | B1 | 1/2004 | Watkins | |
| 2003/0075657 | A1 * | 4/2003 | Joubert | B66F 7/0608 248/277.1 |

* cited by examiner

*Primary Examiner* — Jennifer Simmons

(57) ABSTRACT

A scissor lift apparatus includes a sliding carriage member and a pivoting linkage added to a conventional scissor lift in order to lower the force required to lift a tray holding heavy media during the initial portion of the lifting action where the scissor lift is fully compressed.

20 Claims, 8 Drawing Sheets

POWER ASSIST SCISSOR LIFT

This is a divisional of U.S. application Ser. No. 13/867,272, filed Apr. 22, 2013, Moore et al, and claims priority therefrom. This divisional application is being filed in response to a restriction requirement in that prior application.

This disclosure relates in general to an image forming apparatus, and more particularly, to an image forming apparatus employing an improved lift mechanism for a finisher connected to the image forming apparatus.

It is well known to use scissor lift platforms to facilitate stacking or un-stacking of sheets or booklets of media, for example, those exiting an image forming apparatus. The typical lift table incorporates a support platform and a mechanism for selectively raising or lowering the support platform into a position facilitating its loading or unloading. Vertical movement of the support platform usually is accomplished by use of a scissor arm mechanism that supports the support platform on an underlying base and that is raised and lowered by way of conventional means.

A scissor lift generally consists of two elongated members connected together, usually at or near their midpoints, forming a pivoting mechanism. The scissor lift works by starting the members in an orientation favored towards the horizontal, rather than vertical. To create a change in vertical height, or lift, the members are counter rotated relative to each other from the starting orientation to a more vertical orientation.

Scissor lifts can be driven using many different mechanisms, for example, using hydraulic cylinders, pneumatics, or lead screws as shown in U.S. Pat. Nos. 3,246,876; 5,722,513 and 6,679,479 which are included herein by reference to the extent necessary to practice the present disclosure. The mounting of the drive mechanisms can also vary greatly. Some systems mount the drive mechanism at an optimal angle and allow the drive mechanism to rotate with the scissor arms. Other scissor lifts use a lead screw mounted in a permanent horizontal position.

It has been found that in a current scissor lift mechanism employing a single lead screw mounted in a permanent horizontal position used to raise a stack of paper in a cut-sheet finisher with a large stack height being ideal, a limitation is presented as to how low the scissor lift can collapse. Another limitation dealt with in this type of lift mechanism is the amount of weight that can be lifted from a low, collapsed position. A large stack weight is desirable to enable stacking of large heavy weight media.

The basic operation of a conventional or standard scissor lift 60 that includes a permanently horizontal lead screw drive, as shown in prior art FIGS. 1 and 2, requires that force through a lead screw represented by arrow 61 is applied to legs 62 and 64 that pivot about a shaft at pivot point 65 to lift tray 66. One of the inherent problems with this setup is that the force to drive the scissor lift grows exponentially as the angle of the scissor arms approach horizontal. Because of this, such systems have to be designed with a minimum practical starting height so the lead screw drive can apply enough force to lift the mechanism. This characteristic prevents the scissor lift design from being a very low profile unit. FIG. 3 shows an example of the lead screw drive force for a mechanism lifting 60 lbs., starting with a scissor arm angle of 8° inclined from horizontal. As shown by line A, the total force on the lead screw lessens as the travel of the lead screw increases.

These and other problems in the prior art reveal the need for a new scissor lift mechanism which overcomes one or more of the above-mentioned problems.

Accordingly, disclosed herein is an improved scissor lift mechanism that includes the addition of a sliding carriage member and a pivoting linkage assist device to the scissor lift that will lower the force required to lift a tray during the initial portion of the lifting action when the scissor lift is fully compressed. With a typical scissor lift, the initial force required to raise the lift from a fully compressed state is quite high, requiring a large actuator as well as a sturdy scissor linkage.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
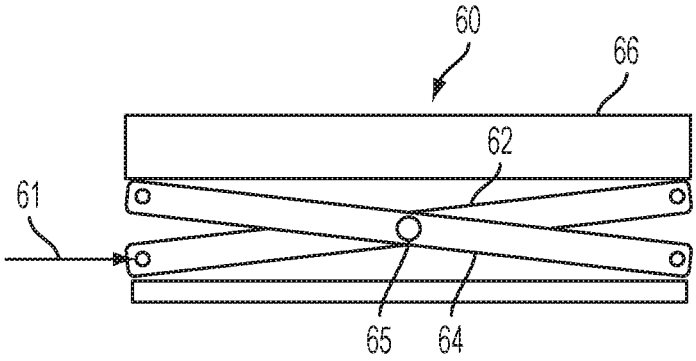
FIG. 1 PRIOR ART
FIG. 1 is a frontal schematic view of a prior art scissor lift at a low angle.
Figure 2:
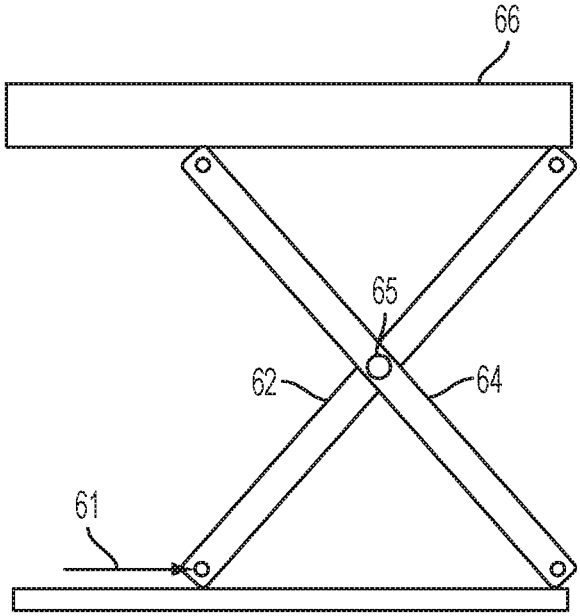
FIG. 2 PRIOR ART
FIG. 2 is a frontal schematic view of the prior art scissor lift of FIG. 1 at a high angle.
Figure 3:
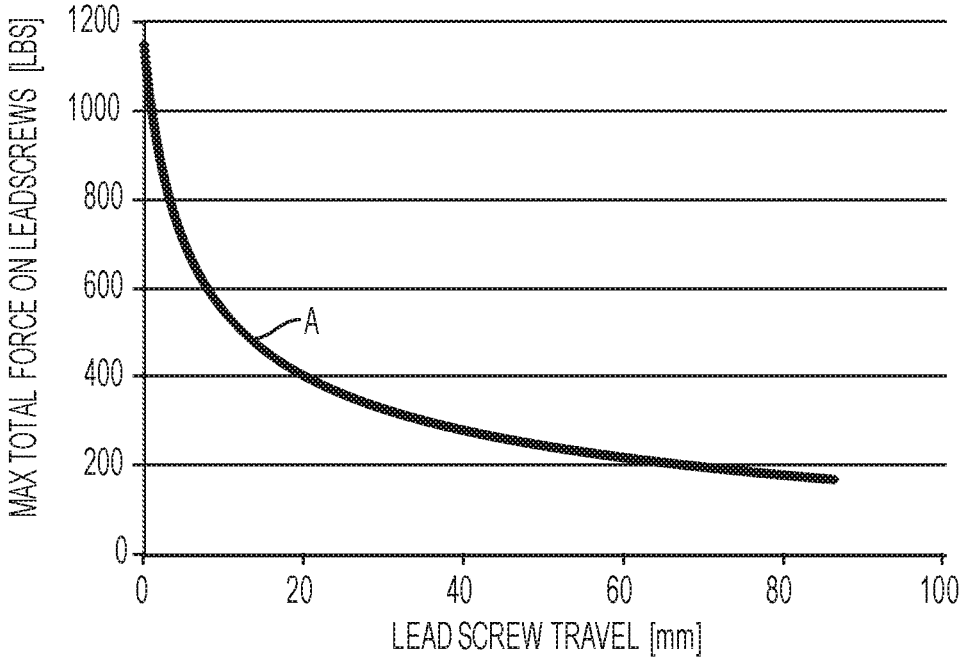
FIG. 3 PRIOR ART
FIG. 3 is a chart showing the lead screw drive force necessary to lift media of a particular weight with the scissor lift of FIG. 1.

The disclosure will now be described by reference to preferred embodiment xerographic printing apparatus that includes a finisher with an improved media scissor lift system.

For a general understanding of the features of the disclosure, reference is made to the drawings. In the drawings, like reference numerals have been used throughout to identify identical elements.

Figure 4:
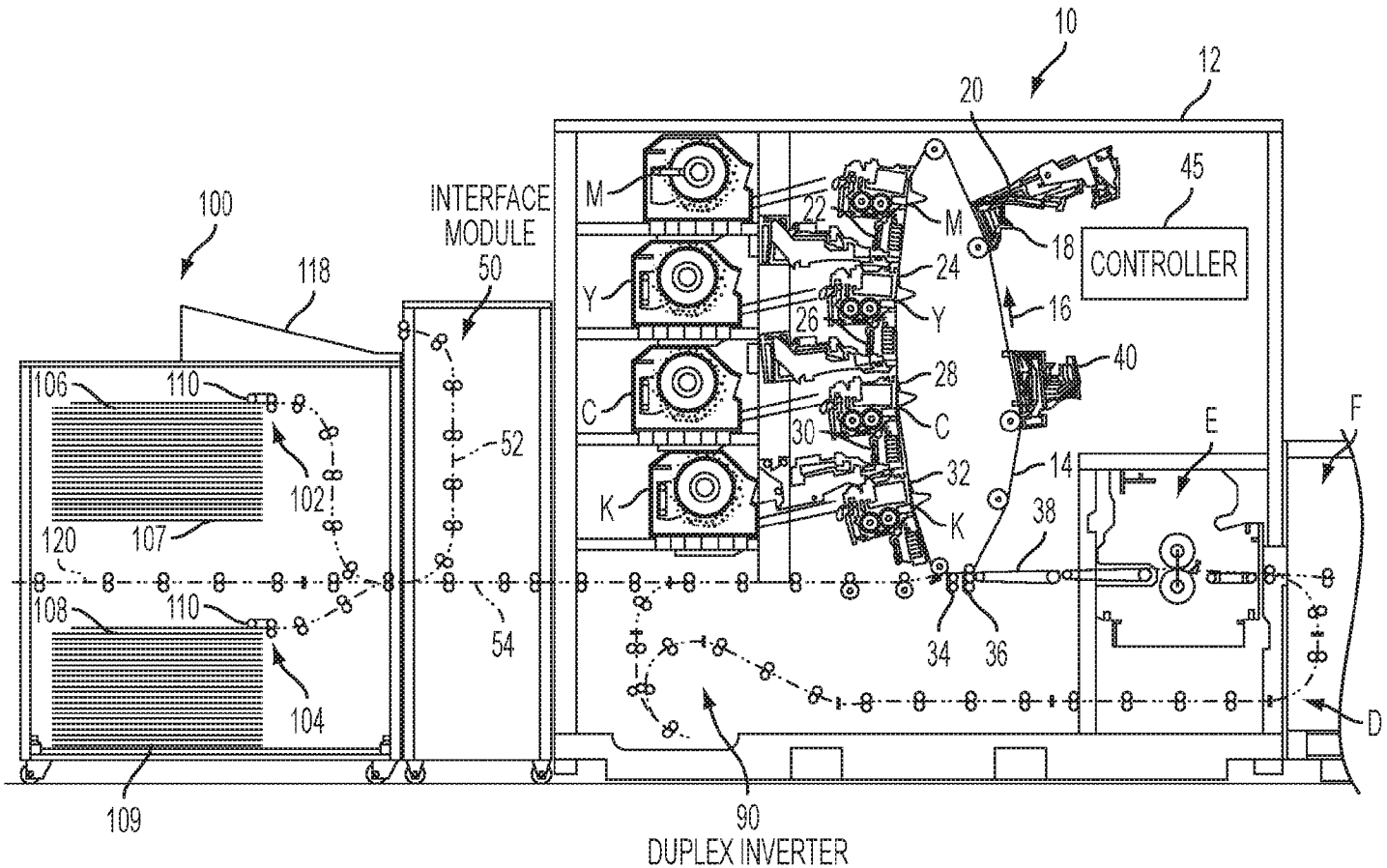
FIG. 4 is a partial, frontal view of an exemplary modular xerographic printer that includes the improved scissor lift system of the present disclosure.

Referring now to printer 10 in FIG. 4 that, as in other xerographic machines, and as is well known, shows an electrographic printing system including the improved scissor lift method and apparatus of the present disclosure. The term "printing system" as used here encompasses a printer apparatus, including any associated peripheral or modular devices, where the term "printer" as used herein encompasses any apparatus, such as a digital copier, bookmaking machine, multifunction machine, etc., which performs a print outputting function for any purpose. Marking module 12 includes a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 through interface module 50 and brings the copy sheets into contact with the image on belt 14. Sheet feeder module 100 includes high capacity feeders 102 and 104 that feed sheets from sheet stacks 106 and 108 positioned on media supply trays 107 and 109 into interface module 50 that directs them either to purge tray 118 through sheet feed path 52 or to imaging or marking module 12 through sheet feed path 54. Additional high capacity media trays could be added to feed sheets along sheet path 120, if desired.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F and onto platform 66 as shown in FIG. 5, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

Figure 5:
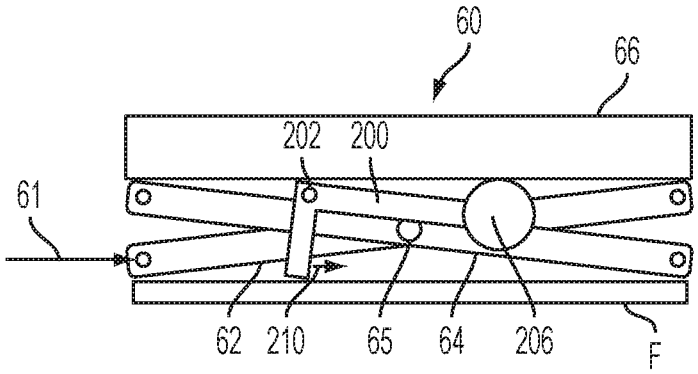
FIG. 5 is a frontal schematic view of an improved scissor lift at a low angle employing a spring assist device.
Figure 6:
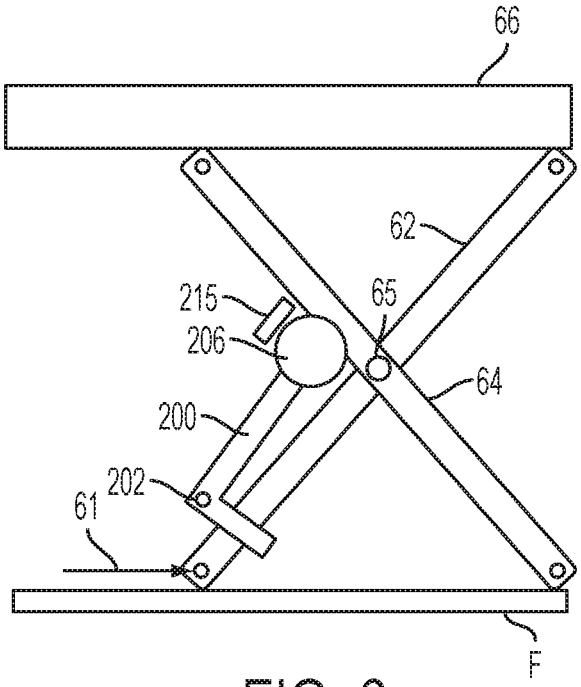
FIG. 6 is a frontal schematic view of the scissor lift of FIG. 5 at a high angle.

Turning now to FIG. 5, an alternative improvement to the prior art scissor lift of FIG. 1 is shown that is positioned in stacker or finisher F of FIG. 4 to receive sheets advanced from marking module 12 that includes a spring assist assembly that comprises an L-shaped arm 200 attached to a fixed pivot 202 at the elbow of the L-shaped arm 200. A roller 206 on one end of the arm contacts the platform 66 of the scissor lift 60. The other end of the arm is connected to an extension spring represented by arrow 210. When the scissor lift is at the bottom of its range, the extension spring is extended, applying a force to the arm. The arm transmits the force to the scissor lift platform 66. As the scissor lift rises, the spring assist arm applies a force for a determined distance as shown in FIG. 6 before hitting a hard stop 215. The hard stop prevents the arm from over rotating. When the arm hits the hard stop, the spring assist actuation comes to an end. For the remaining duration of the lift, the lead screws are acting directly on the leg(s) of the scissor lift. Essentially, the remaining motion is identical to that of a conventional scissor lift.

Figure 7:
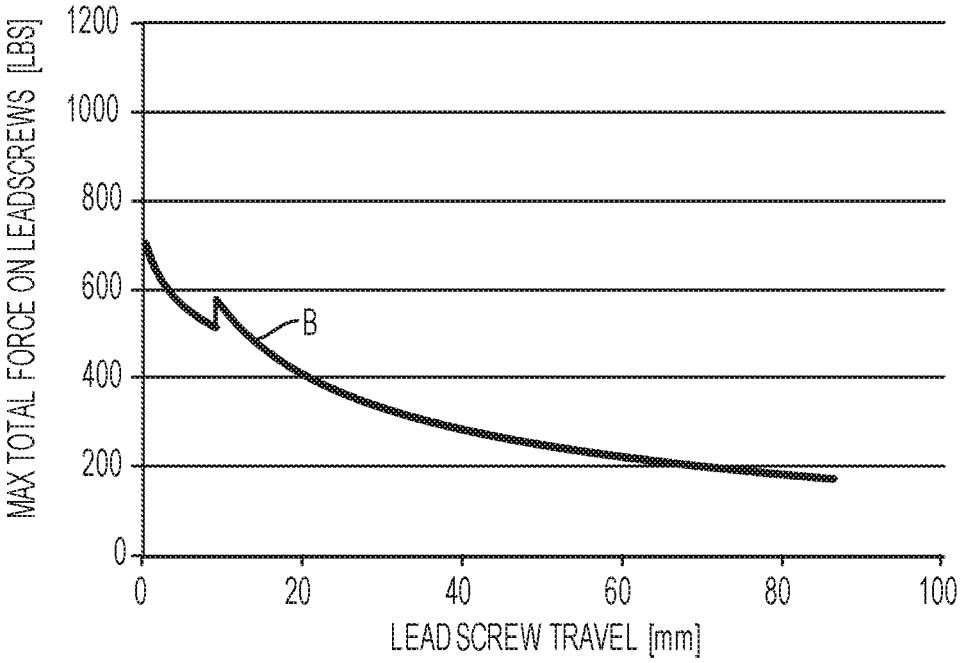
FIG. 7 is a chart showing the lead screw drive force necessary to lift media of a particular weight with the improved scissor lift of FIG. 5.

The chart in FIG. 7 shows in line B an example of the lead screw drive force for the scissor lift of FIGS. 5 and 6 lifting 60 lbs., starting with a scissor arm angle of 8° inclined from horizontal with a spring assist assembly. Compared to the forces for the conventional scissor lift of FIG. 1, it can be seen that the peak drive forces are lowered by approximately 40%.

Figure 8:
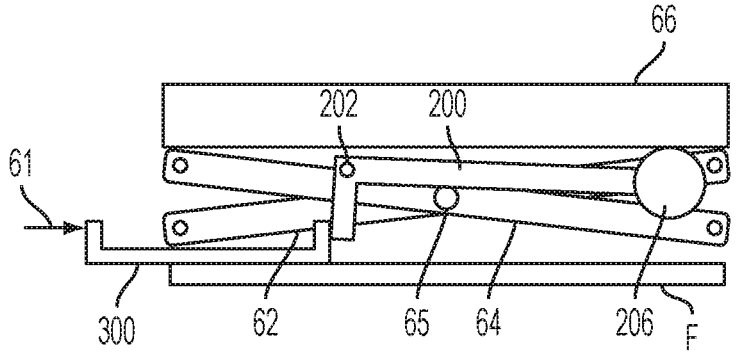
FIG. 8 is a frontal schematic view of an alternative scissor lift at a low angle employing a power assist lift device.
Figure 9:
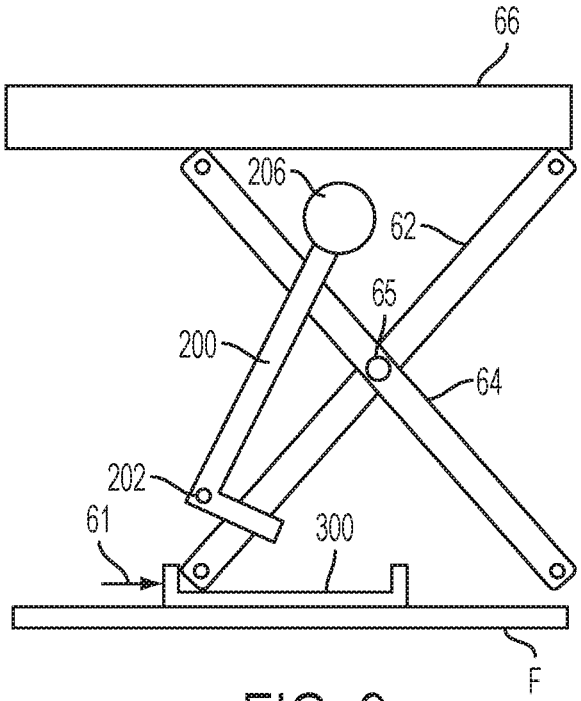
FIG. 9 is a frontal schematic view of the improved scissor lift of FIG. 8 at a high angle.

In accordance with the present disclosure, an improved scissor lift apparatus embodiment is shown in FIGS. 8 and 9 and includes a power assist assembly that utilizes extending the travel of a lead screw (not shown). A force 61 is applied to arm 200 by the lead screw instead of spring(s), thereby providing a power assist assembly. In order to drive the power assist assembly separate from the scissor lift, the force from the lead screw assembly must be decoupled from the scissor lift members. A sliding carriage member 300 is added and directly driven by the lead screw assembly. The power assist assembly of FIGS. 8 and 9 includes sliding carriage member 300. From the lift in a lowered position, the sliding carriage member 300 initially applies a force directly to the power assist assembly as shown in FIG. 8 which includes an L-shaped arm 200 attached to a fixed pivot 202 at the elbow of the L-shaped arm 200. A roller 206 on one end of the arm contacts the platform 66 of the scissor lift 60. When the scissor lift is at the bottom of its range, the sliding carriage is moved by a force 61 thereby applying a force to the arm 200. The arm 200 transmits the force to the scissor lift platform 66 to start vertical motion. Carriage member 300 is also designed to transmit force from the lead screw assembly to the scissor members. An offset is designed into the carriage so the lead screws drive the power assist arm a given distance before the carriage catches up to the scissor members and begins directly driving. An example of the carriage driving the scissor members directly can be seen in FIG. 9.

Figure 10:
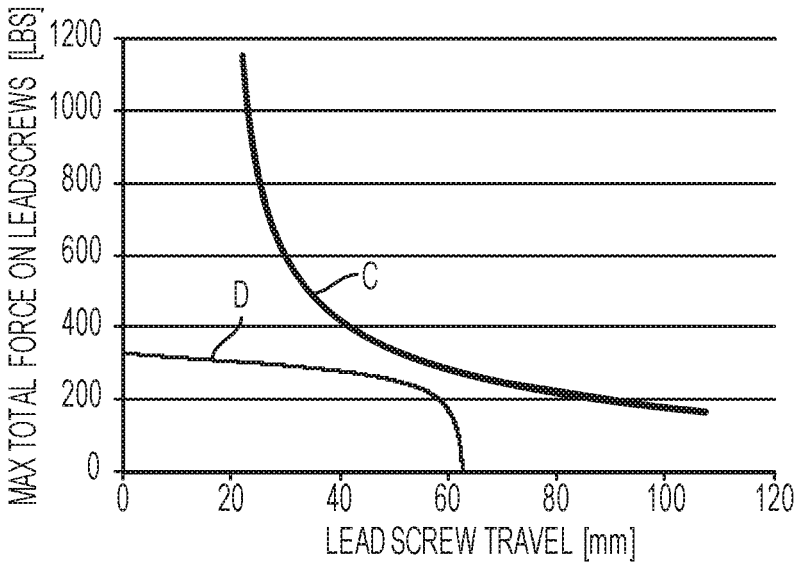
FIG. 10 is a chart showing individual force-to-drive curves resulting from lifting media by employing the power assist spring scissor lift device of FIG. 8.
Figure 11:
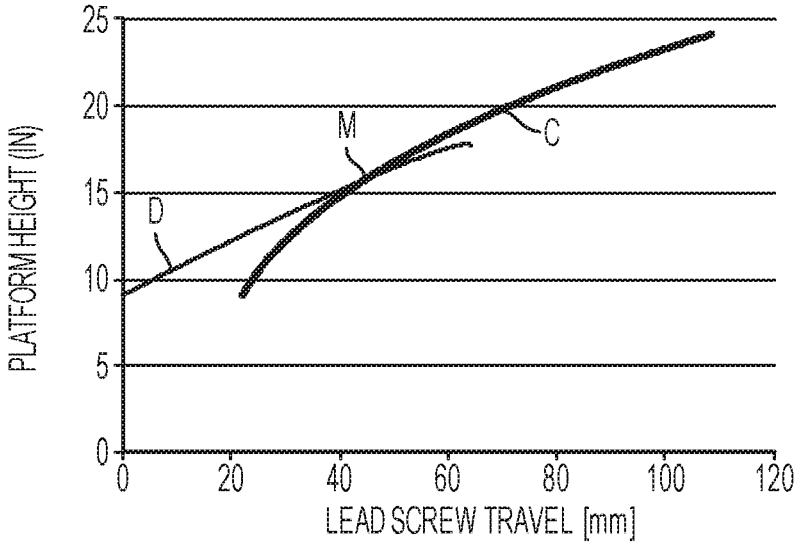
FIG. 11 is a chart showing individual platform-height curves for the improved power assist spring lift device of FIG. 8.

An example of the force curves and the displacement curves is shown in FIGS. 10 and 11, respectively. FIG. 10 shows individual curves broken down into each component. Line C represents the individual force-to-drive curve of the conventional scissor lift of FIG. 1 and line D represents the individual force-to-drive curve employing the power assist arm. The critical point M in FIG. 11 is where the platform heights are equal, approximately 45 mm of lead screw travel. At this point, the lead screw assembly force is handed off from the power assist assembly and power assist arm to the scissor members. From this point forward, the lead screws drive the scissor members directly, exactly the same as in the conventional scissor lift shown in FIG. 1.

Figure 12:
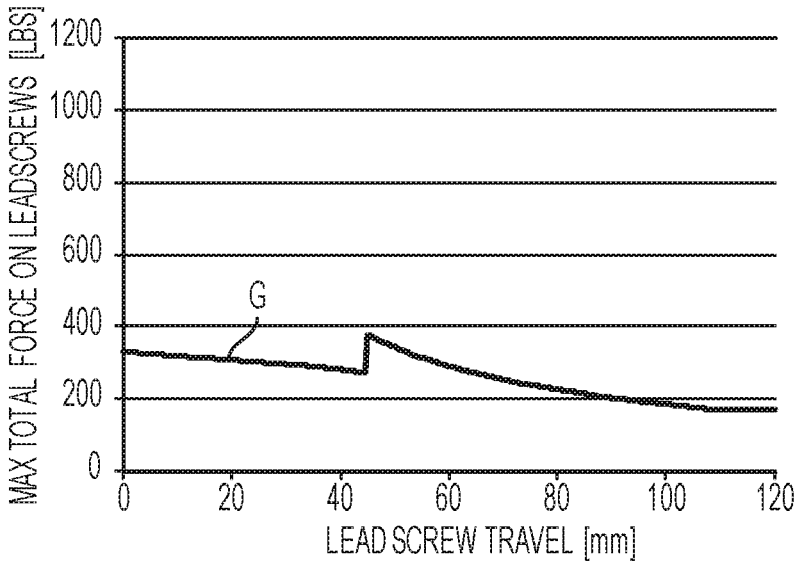
FIG. 12 is a chart showing power assist scissor lift lead screw force resulting from use of the mechanism of FIG. 8.
Figure 13:
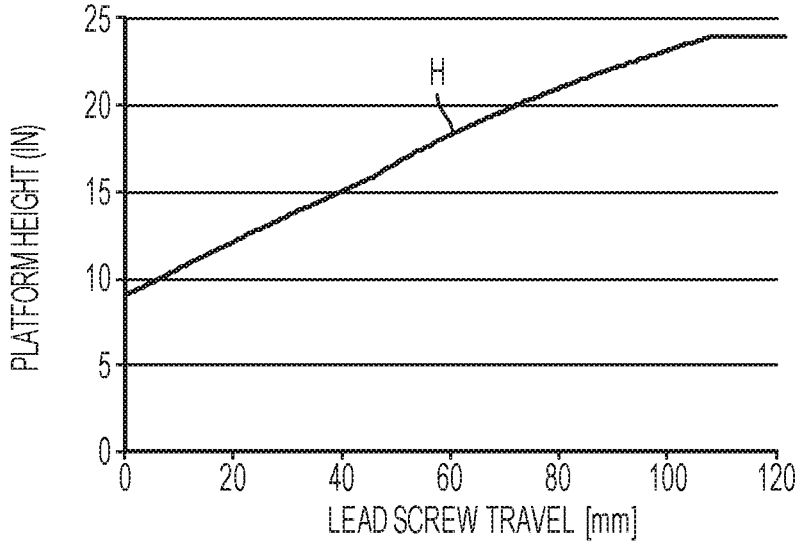
FIG. 13 is a chart showing power assist scissor lift platform-height curves resulting from use of the mechanism of FIG. 8.

In FIG. 12, the motion of the power assist scissor lift that comprises the sliding carriage member is represented by the force curve G which shows that less force is required to lift 60 lbs., starting with a scissor arm angle of 8° inclined from horizontal than with the conventional scissor lift. The force curve G shifts from the power assist assembly to the conventional scissor lift at the point of handoff after approximately 45 mm lead screw travel. The lead screw force at the start of movement, from a fully down position, is reduced by up to 70% for this particular configuration. The power assist scissor lift platform-height curve H in FIG. 13 shows increased platform height in less lead screw travel time over conventional scissor lifts when using the power assist scissor lift of the present disclosure.

In recapitulation, an improvement to conventional scissor lifts used in a finisher of a xerographic device to lift tray supported heavy weight copy sheets or media is shown that includes the addition of a sliding carriage member and a pivoting linkage to a conventional scissor lift that will lower the force required to lift the tray during the initial portion of the lifting action where the scissor lift is fully compressed. The lower forces involved results in a cost savings for both the actuator and scissor linkage as well as increased lift capacity. As an additional benefit, the profile of the scissor lift is lowered by use of the sliding carriage member and pivoting linkage scissor lift improvement.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic device, comprising:

a marking module for printing images onto media;

a feeder module including a media supply for feeding media from a stack to said marking module;

a finisher module including a bottom support and a movable tray for receiving imaged media from said marking module; and a scissor lift apparatus on which said movable tray is mounted for lowering and raising said movable tray as sheets of media are deposited thereon and removed therefrom, said movable tray being supported by a first leg having one end pivotally attached to said movable tray and an opposite end pivotally attached to said bottom support and an intermediate portion therebetween; a second leg having one end supporting said movable tray and an opposite end pivotally attached to said bottom support and an intermediate portion therebetween, and wherein said second leg is transverse to said first leg and the intermediate portions of said first leg and said second leg are pivotally connected about a shaft; and a pivoting linkage, said pivoting linkage being configured to be pivotally driven in a counter-clockwise direction and contact said movable tray in order to lower the force required to lift said movable tray during an initial portion of the lifting action when said scissor lift is fully compressed, and wherein said pivoting linkage comprises an L-shaped arm and a carriage member adapted to contact said L-shaped arm during said initial portion of the lifting action when said scissor lift is fully compressed to provide a power assist to said L-shaped arm and thereby lower the force required to lift said scissor lift apparatus.

2. The xerographic device of claim 1, wherein said carriage member is U-shaped.

3. The xerographic device of claim 1, wherein said L-shaped arm includes a pivot point at an elbow thereof.

4. The xerographic device of claim 1, wherein said L-shaped arm includes a member at one end thereof for contacting said movable tray.

5. The xerographic device of claim 4, wherein said member at one end of said L-shaped arm is a roller.

6. The xerographic device of claim 4, wherein said member at one end of said L-shaped arm is prevented from rotating beyond a predetermined point by a stop member.

7. A printing apparatus, comprising:

an image processor that receives image data from a source and processes it;

at least one copy sheet feed tray adapted to feed copy sheets to receive images thereon from said image processor; and a finisher for receiving and handling copy sheets having images thereon, said finisher including an output tray and a scissor lift mechanism connected to said output tray adapted to raise and lower said output tray, said scissor lift mechanism including a base frame and work supporting member disposed over said base frame, scissor members including a pair of relatively movable crossed scissor arms, and a pivot member interconnecting said scissor arms intermediate their ends for relative movement of said arms about a pivot axis for the arms; and wherein said scissor lift mechanism includes the improvement of a power assist assembly that comprises an L-shaped arm, said L-shaped arm being attached to a fixed pivot at an elbow thereof and having a contact member at one end thereof for contacting said work supporting member, whereby rotation of said L-shaped arm assists in lifting said output tray from a collapsed position, and wherein said power assist assembly includes a carriage member, said carriage member being adapted to contact said opposite end of said L-shaped arm to assist in lifting said output tray from said collapsed position to thereby lessen the force required to lift said output tray.

8. The printing apparatus of claim 7, wherein said contact member is circular.

9. The printing apparatus of claim 7, wherein said power assist device is adapted to contact said opposite end of said L-shaped arm.

10. The printing apparatus of claim 7, wherein said contact member is a roller.

11. The printing apparatus of claim 7, wherein said carriage member is adapted to transmit force from a power source through said L-shaped arm to said work supporting member.

12. A xerographic device that includes a method for lowering the force required to raise a media tray with a scissor lift mechanism, comprising:

providing a marking module for printing images onto media;

providing a feeder module including a media supply for feeding media from a stack to said marking module;

providing a finisher module including a bottom support and a movable media tray for receiving imaged media from said marking module;

providing a scissor lift apparatus on which said movable tray is mounted for lowering and raising said movable tray as sheets of media are deposited thereon and removed therefrom, said movable tray being supported by a first leg having one end pivotally attached to said movable tray and an opposite end pivotally attached to said bottom support and an intermediate portion therebetween; a second leg having one end supporting said movable tray and an opposite end pivotally attached to said bottom support and an intermediate portion therebetween, and wherein said second leg is transverse to said first leg and the intermediate portions of said first leg and said second leg are pivotally connected about a shaft;

providing a pivoting linkage that includes an L-shaped arm, said pivoting linkage being configured to be pivotally driven in a counter-clockwise direction and contact said movable media tray in order to lower the force required to lift said movable media tray during an initial portion of the lifting action when said scissor lift apparatus is fully compressed; and providing a carriage member adapted to be forced into contact with said L-shaped arm during an initial portion of lifting action when said scissor lift apparatus is fully compressed to provide a power assist to said L-shaped arm and thereby lower the force required to lift said scissor lift apparatus.

13. The method of claim 12, including providing a member at one end of said L-shaped arm for contacting said movable media tray.

14. The method of claim 13, including providing said member at one end thereof for contacting said movable tray in a circular shape.

15. The method of claim 13, including providing said member at one end of said L-shaped arm as a roller.

16. The method of claim 13, including preventing said member at one end of said L-shaped arm from rotating beyond a predetermined point by a stop member.

17. The method of claim 13, including preventing said member at one end of said L-shaped arm from rotating beyond a predetermined point with a stop member.

18. The method of claim 12, wherein said carriage member is U-shaped.

19. The method of claim 18, including configuring said carriage member to transmit force from a power source through said L-shaped arm to said movable tray.

20. The method of claim 12, including providing said L-shaped arm with a pivot point at an elbow thereof.

* * * * *